United States Patent [19]

Ballester

[11] 4,334,631

[45] Jun. 15, 1982

[54] COVER AND CONTAINER ASSEMBLY

[76] Inventor: José F. Ballester, GPO Box 4523, San Juan, P.R. 00936

[21] Appl. No.: 209,823

[22] Filed: Nov. 24, 1980

[51] Int. Cl.[3] ..... B65D 41/16; B65D 41/18

[52] U.S. Cl. ..... 220/306; 220/307; 206/508

[58] Field of Search ..... 220/306, 307; 150/0.5; 206/508

[56] References Cited

U.S. PATENT DOCUMENTS

| | | | |
|---|---|---|---|
| 4,210,258 | 7/1980 | Von Holdt | 220/306 |
| 4,256,240 | 3/1981 | Woinarski | 220/306 |
| 4,293,080 | 10/1981 | Letica | 220/306 |

*Primary Examiner*—George T. Hall

*Attorney, Agent, or Firm*—John N. Bain; Paul H. Kochanski

[57] ABSTRACT

An improved cover and can assembly having a novel interlocking assembly comprised of a two "ball and socket" configuration thereby providing a greater surface or contact area between the cover or lid and the container. The novel interlocking assembly provides a snap-type closing which insures a tighter fit with far less chance of opening with the cover being provided with an annular groove including rib members located near the edge of the cover with the rib members providing means for separating the cover from the container.

6 Claims, 3 Drawing Figures

COVER AND CONTAINER ASSEMBLY

FIELD OF THE INVENTION

This invention relates to an improved cover and container assembly provided with a hermetic seal, and more particularly to an improved cover and container assembly formed of plastic and provided with a hermetic seal and with a novel opening assembly for facile removal of the cover from the container.

BACKGROUND OF THE INVENTION

With the advent of plastics technology there has been movement in the container industry from metal storage cans or containers to like products made out of plastic. Such change in materials of construction has led to problems in the art of sealing the plastic containers to prevent spillage or leakage since such plastic containers are more pliable and lack the rigid construction of the metal container. The plastic containers appear to be more susceptible to accidentally opening when dropped or leaking when they are roughly handled during transfer operations.

Many solutions have been advanced to alleviate these problems, by the development of interlocking sealing assemblies. One such assembly is a single interlocking seal to attempt to prevent such occurrences as disclosed in U.S. Pat. No. 3,840,144 to Dry.

A further development is disclosed in U.S. Pat. No. 4,210,258 to von Holdt wherein there is exhibited a double interlocking seal on a plastic cover and container. The addition of the second interlock appears to overcome some of the problems that have existed.

All such prior art sealing assemblies require that an individual when attempting to open the container must apply a force with a flat edge object a plurality of times around the peripheral edge of the cover of the container. This procedure can once again lead to the problem of accidental spills since it is necessary to rotate the container to reach the point where force will be applied.

OBJECTS OF THE INVENTION

An object of the present invention is to provide an improved double interlocking hermetic seal capable of being opened with a single unitary force.

Another object of the invention is to provide a cover and container assembly incorporating the benefit of the opening mechanism with the sealing assembly designed to permit for a tighter fit.

Still another object of the invention is to provide an improved cover and container assembly provided with a hermetic seal having a sealing surface accommodating dimensional variations during the manufacture as well as to accommodate a greater degree of distortion of the package.

Other objects and advantages of the present invention will become apparent from the following description of the embodiment.

SUMMARY OF THE INVENTION

The objects of the present invention are achieved by an improved cover and can assembly having a novel interlocking assembly comprised of a two "ball and socket" configuration thereby providing a greater surface or contact area between the cover or lid and the container. The novel interlocking assembly comprised of a two "ball and socket" configuration thereby provides a snap-type closing which insures a tighter fit with less chance of opening with the cover being provided with an annular groove including rib members located near the edge of the cover with the rib members providing means for separating the cover from the container.

BRIEF DESCRIPTION OF THE DRAWINGS

Understanding of the invention will be facilitated by reference to the drawings and the accompanying detailed description.

DETAILED DESCRIPTION OF THE INVENTION

Figure 1:
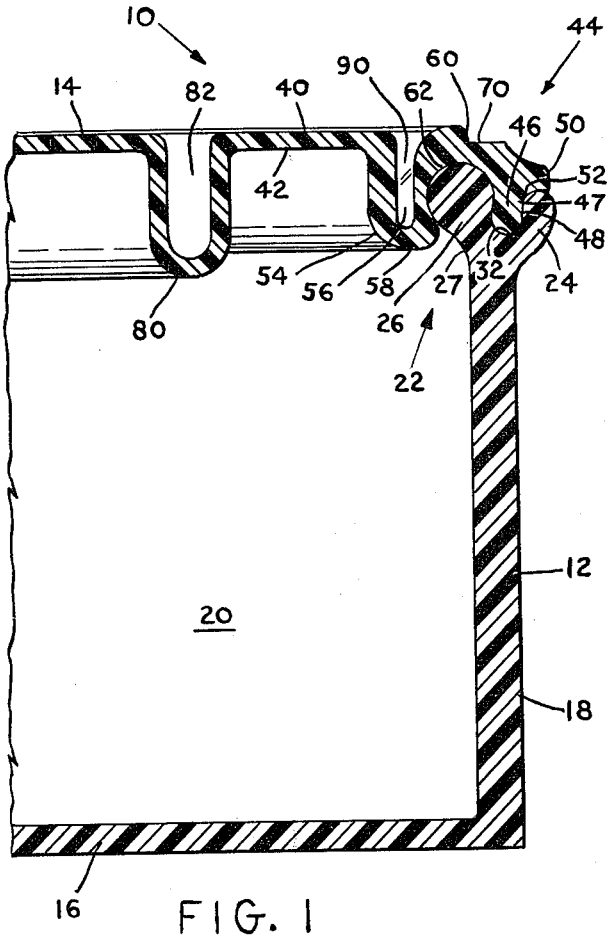
FIG. 1 is an elevational view partially in section of the cover and container assembly of the present invention.

Referring now to FIG. 1, there is illustrated a cover and container assembly generally indicated as 10, normally produced from plastic type material and comprised of a container 12 and a cover 14. The container 12 is comprised of a bottom wall 16 and a cylindrically shaped side wall 18 forming chamber 20 for holding a material. The side wall 18 extends upwardly terminating in a generally U-shaped interlocking sub-assembly, generally indicated as 22.

The sub-assembly 22 is formed of an outwardly directed annular bead member 24 and a larger inwardly directed annular bead member 26 having a narrow neck portion 27.

The outwardly directed annular bead member 24 cooperatively defines with the inwardly directed annular bead 26 a generally U-shaped annular locking slot 32.

The cover 14 is circular in shape having an outer surface 40 and an inner surface 42. Located on the circumference of the cover 14 is interlocking sub-assembly 44 which is positioned to cooperatively engage the interlocking sub-assembly 22 of container 12.

The interlocking sub-assembly 44 is comprised on the inner surface 42, of a downwardly directed annular bead member 46 having a narrow neck 47 positioned to be cooperatively snap-locked in the U-shaped annular locking slot 32 which is of a conforming shape to bead 46 of the interlocking sub-assembly 22 of side wall 18 to provide a tight fit, such fit is accomplished if downwardly directed bead 46 is inserted to the past center point. The outside annular surface 48 of projection 46 terminates in an edge 50, in such a way as to produce a semicircular annular groove 52 wherein the outwardly directed annular bead 24 of side wall 18 can be cooperatively inserted. In the preferred embodiment of the invention, as shown the edge 50 should not extend beyond or overhang the side wall 18.

Interlocking sub-assembly 44 is further comprised of an outer exterior U-shaped wall member 54 which forms an annular groove 56. This outer exterior U-shaped wall member 54 is further comprised of an outwardly directed abutting portion 58. The said outwardly directed abutting portion can be molded to provide a cam interlock or a face to face positive interlock. The outwardly directed abutting portion 58 located on the inner surface 42 of cover 14 which in conjunction with the inner annular surface 60 of the downwardly directed annular bead 46 form a U-shaped annular locking slot 62 of a conforming shape wherein the inwardly directed annular bead 26 of side wall 18 can be cooperatively inserted to form a tight fit. This thereby joins the interlocking sub-assembly 22 of side wall 18 with the interlocking sub-assembly 44 of cover 14.

The outer surface 40 of cover 14 is also provided with a step-in ledge 70 around the circumference of cover 14 to facilitate the stacking of containers to prevent them from sliding off.

The cover 14 is provided with an interior intermediate U-shaped wall member portion 80 forming a second annular groove 82 to help isolate the hydraulic forces transferred from the contents of the container 12 to the cover 14 upon impact.

Figure 2:
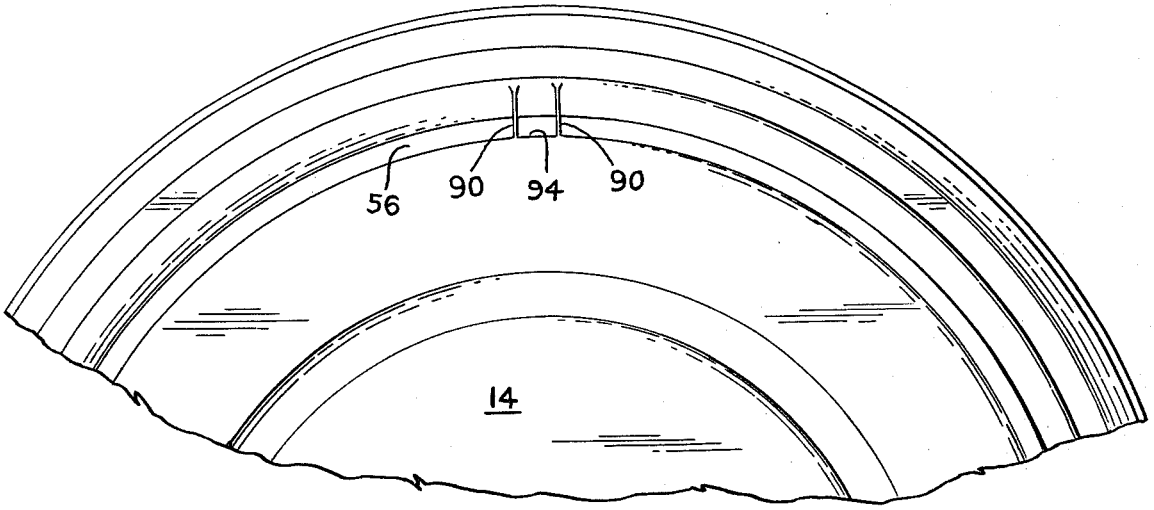
FIG. 2 is a fragmentary top view of a container cover assembly of FIG. 1.

Referring now to FIG. 2, showing a fragmentary portion of cover 14 including the annular groove 56 wherein there are one or two rib members 90 extending transversally across the annular groove 56 forming an opening cavity 94. By insertion of a flat-edged object, such as a shaft of a screwdriver within the opening cavity 94 and an exersion of a downward rotational force on shaft of screwdriver toward the center of cover 14 can disengage the interlocking assemblies 22 and 44 easily open the container. Although only one or two rib members 90 are needed to open up the cover 14 from container 12, a plurality of rib members 90 may be positioned in a plurality of areas within annular groove 56.

Figure 3:
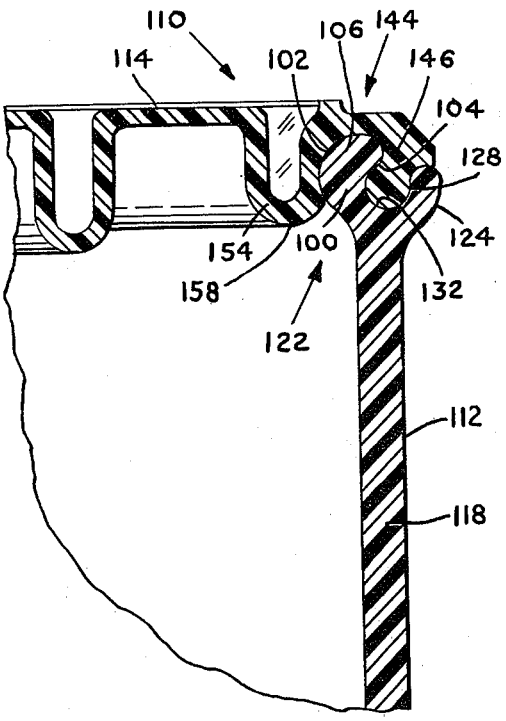
FIG. 3 is a fragmentary vertical section of a cover and container showing another embodiment of the interlocking assembly.

FIG. 3 shows another embodiment of this invention wherein many of the elements are the same as in FIGS. 1 and 2. The side wall 118 of container 112 terminates in a U-shaped interlocking sub-assembly 122 which is comprised of an outwardly directed annular bead 124 and a larger inwardly directed annular arcuate projection 100.

The inwardly directed annular arcuate projection 100 is comprised of a convex annular outer surface 102 and an inner concave annular surface 104. The inner concave annular surface 104 meets cooperatively with the inside annular surface 128 of the outwardly directed annular bead 124 to define generally a U-shaped annular locking slot 132 conform to the shape of the downwardly directed annular bead 46 in the interlocking sub-assembly 144 of cover 114 to produce a snap-lock fit.

To accept the inwardly directed annular arcuate projection 100 the outwardly directed abutting portion 158 of the outer exterior U-shaped wall member 154 and the inner annular surface 60 of the downwardly directed annular bead 146 are molded to form an arcuate cavity 106 which will conform to the shape of the inwardly directed annular arcuate projection 100 to provide for a tight fit. The described change in this embodiment is to facilitate the manufacture of the cover and container assembly 110 for high speed molding.

While particular embodiments of the invention have been shown and described it is to be understood that the scope of the invention is not limited to these embodiments since modifications can be made by one skilled in the art.

What is claimed is:

1. An improved cover and container assembly comprising:

(a) a container having a bottom wall and a cylindrically shaped side wall, said side wall having a first annular locking member projecting outwardly from a terminus thereof and a second annular locking member projecting inwardly therefrom and cooperatively defining an interlocking means; and (b) a cover having a downwardly projecting annular locking member circumferentially formed thereabout, said cover having an outer exterior U-shaped wall member forming an annular groove having an outwardly directed abutting part on a bottom of said outer exterior U-shaped wall member, said outwardly directed abutting part cooperatively defining with said downwardly projecting annular locking member an interlocking means, said interlocking means of said container cooperatively engaging said interlocking means of said cover to provide a snap-lock fit to hermetically seal said cover to said container.

2. The improved cover and container assembly as defined in claim 1 further comprising at least one rib member in the annular groove formed by the said outer exterior U-shaped wall member.

3. An improved cover and container assembly as defined in claims 1 or 2 and further comprising an interior intermediate U-shaped wall member forming a second annular groove.

4. An improved cover and container assembly as defined in claims 1 or 2 wherein said second annular interlocking member being beadlike in shape wherein said second interlocking means conforms with said shape producing a snap-lock fitting.

5. An improved cover and container assembly in accordance with claims 1 or 2 wherein said second annular interlocking member being arcuatelike in shape wherein said second interlocking means conforms with said shape producing a tight fit.

6. An improved cover and container assembly in accordance with claim 1 wherein a plurality of said pair of rib members placed in said annular groove spaced equidistantly apart providing a plurality of said opening cavities.

* * * * *